US005172501A

United States Patent [19]

Pippins

[11] Patent Number: 5,172,501

[45] Date of Patent: Dec. 22, 1992

[54] TOOTH ASSEMBLY FOR EXCAVATING APPARATUS

[76] Inventor: Sherlock K. Pippins, 306 Rebecca Cir., Longview, Tex. 75601

[21] Appl. No.: 777,601

[22] Filed: Oct. 15, 1991

Related U.S. Application Data

[63] Continuation-in-part of Ser. No. 541,599, Jun. 21, 1990, abandoned.

[51] Int. Cl.[5] ..... E02F 9/28

[52] U.S. Cl. ..... 37/142 R; 37/141 T; 299/91

[58] Field of Search ..... 172/701.3, 719, 713, 172/772.5; 37/142 R, 141 T, 141 R, 142 A; 299/91, 93

[56] References Cited

U.S. PATENT DOCUMENTS

| | | | |
|---|---|---|---|
| 1,216,290 | 2/1917 | Dickson . | |
| 1,419,047 | 6/1922 | Hanks et al. . | |
| 2,339,128 | 1/1944 | Younie | 37/142 R |
| 2,739,395 | 3/1956 | Stratton | 37/142 R |
| 3,082,555 | 3/1963 | Hill | 37/142 R |
| 3,339,805 | 10/1974 | Stepe | 37/142 R |
| 3,496,658 | 2/1970 | Eyolfson | 37/142 R |
| 3,896,569 | 7/1975 | Thompson et al. | 37/141 T |
| 3,982,339 | 9/1976 | Nilsson | 37/141 T |
| 4,428,131 | 1/1984 | Hahn | 37/142 R |
| 4,587,751 | 5/1986 | Sjogren et al. | 37/142 R |
| 4,716,667 | 1/1988 | Martin | 37/142 R |
| 4,762,184 | 8/1988 | Yeomans | 37/142 R |
| 4,823,486 | 4/1989 | Diekevers et al. | 37/142 R |
| 5,075,986 | 12/1991 | Smith et al. | 37/142 R |
| 5,088,214 | 2/1992 | Jones | 37/141 R |

*Primary Examiner*—Randolph A. Reese
*Assistant Examiner*—Spencer Warnick
*Attorney, Agent, or Firm*—John M. Harrison

[57] ABSTRACT

A tooth assembly for mounting on the tooth horns of excavating or levelling apparatus buckets, shovels or alternative digging mechanisms. The tooth assembly includes a wedge-shaped adapter shaped for seating on the tooth horn, a tooth point transversely slidably engaging and bolted or otherwise locked to the adapter for engaging the material to be excavated and top and bottom wear caps also transversely slidably engaging and bolted to the adapter adjacent to the tooth point, for extending the life of the tooth assembly in the excavating or levelling operation.

20 Claims, 4 Drawing Sheets

FIG. 1
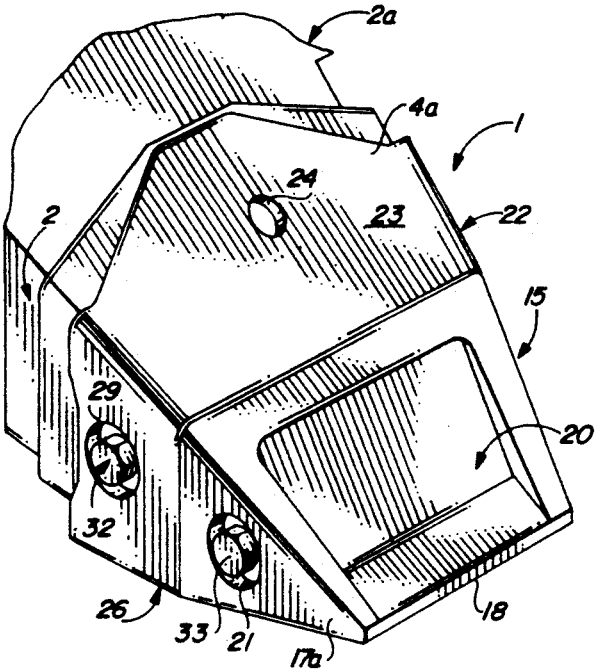
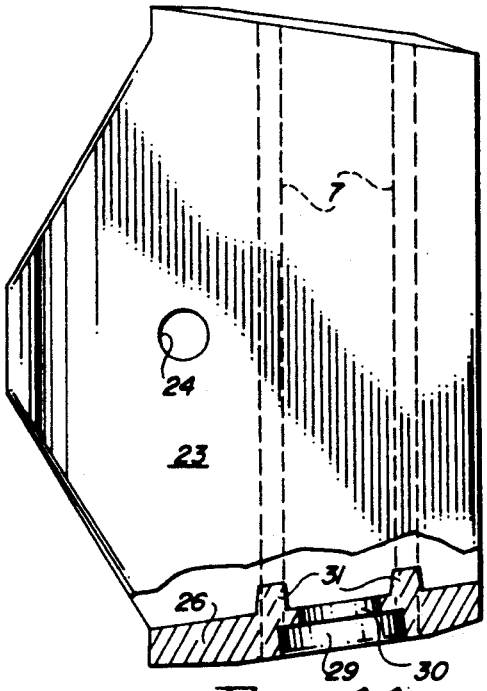
FIG. 11
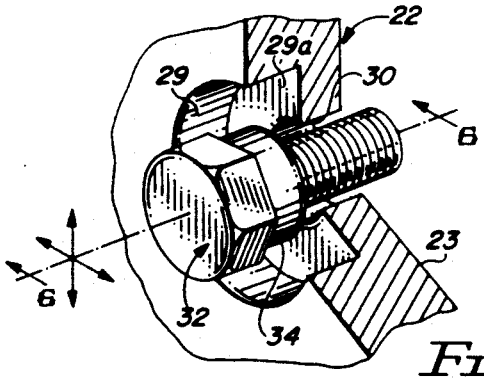
FIG. 5
FIG. 4
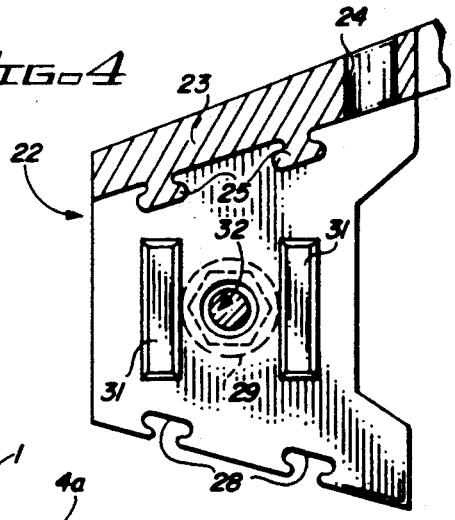
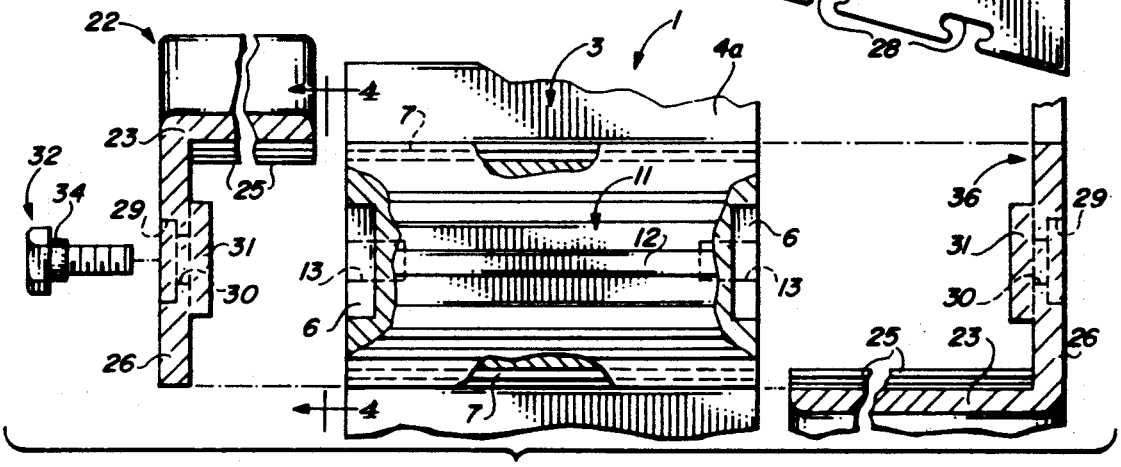
FIG. 3

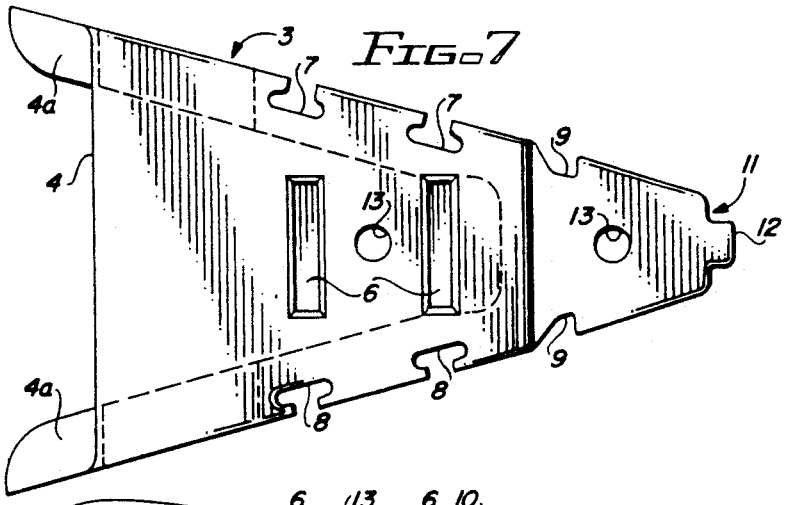
FIG. 7
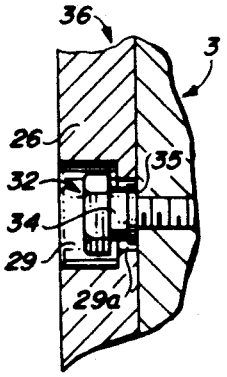
FIG. 6
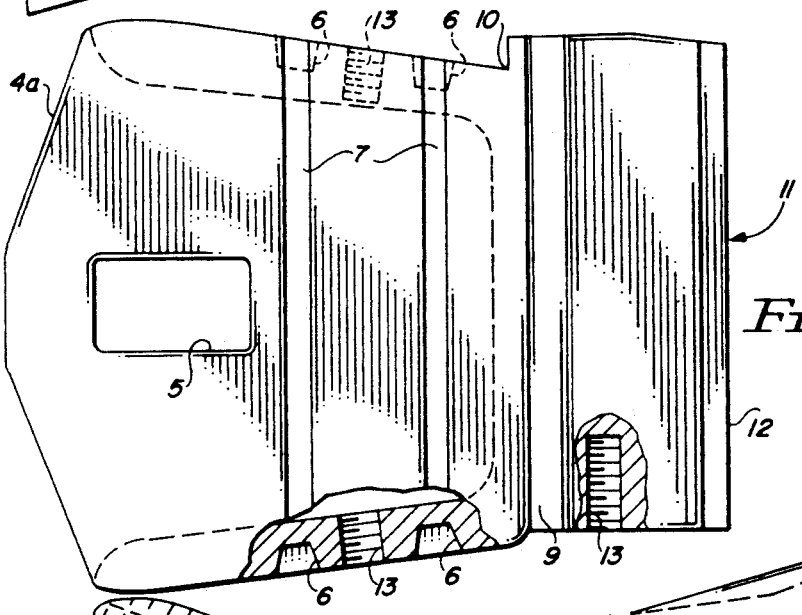
FIG. 8
FIG. 9
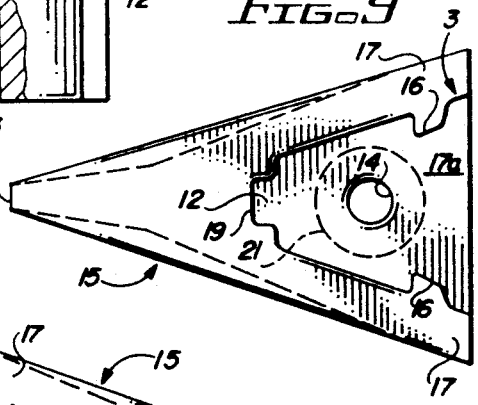
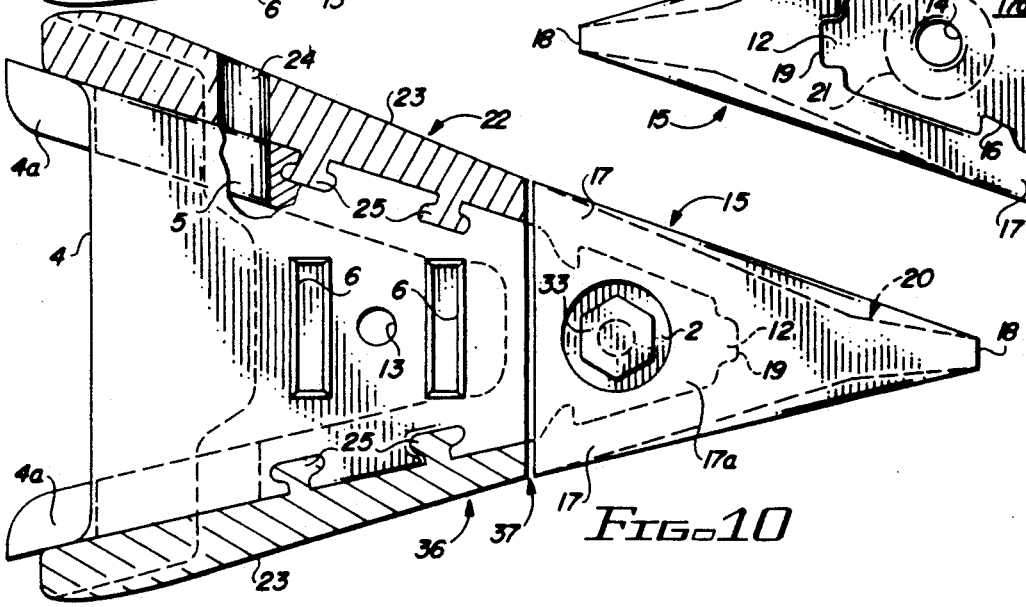
FIG. 10

TOOTH ASSEMBLY FOR EXCAVATING APPARATUS

CROSS REFERENCE TO RELATED APPLICATIONS

This application is a continuation-in-part of my copending U.S. application Ser. No. 07/541,599, filed Jun. 21, 1990 now abandoned.

BACKGROUND OF THE INVENTION

Field of the Invention

This invention relates to digging and levelling apparatus such as draglines, backhoes, front-end loaders and like equipment and more particularly, to a tooth assembly for mounting on tooth horns of dragline buckets, backhoe shovels and front-end loader excavation or levelling equipment and engaging the material to be excavated or levelled. In a preferred embodiment, each tooth assembly is characterized by a wedge-shaped adapter which mounts directly on the tooth horn of the bucket, shovel or alternative digging or scraping mechanism of the operation equipment. A wedge-shaped tooth point is transversely seated on and bolted to the extending end of the adapter for engaging the material to be excavated or levelled and a pair of wear caps transversely encapsulate and are bolted to that portion of the adapter which projects between the tooth point and the tooth horn, for extending the life of the tooth assembly during the excavating or levelling operation.

One of the problems which is inherent in excavation and levelling operations using heavy equipment such as draglines, backhoes, front-end loaders and similar equipment is that of rapidly wearing the equipment teeth during the excavation or levelling operation. This problem is exacerbated under circumstances where the material to be excavated contains rocks, sand, concrete or other hard or abrasive particles which rapidly wear the bucket or shovel teeth and require expensive periodic retrofits or replacement of the bucket or shovel. Accordingly, it is customary in the industry to provide removable excavating teeth which mount on adapters positioned on shaped, spaced tooth horns provided in the bucket, shovel or other material-moving apparatus, which teeth are typically attached to the tooth adapter using pins or other techniques for removal due to wear. A problem associated with removing these teeth due to periodic wear is the difficulty of driving retaining pins or the like from registering apertures in the teeth and tooth adapters to remove and replace the teeth. Typically, this operation is effected using a large hammer, wherein the pins are manually driven from the teeth and tooth adapter, a procedure which requires considerable effort and is costly due to the labor involved.

Accordingly, it is an object of this invention to provide a tooth assembly for mounting on buckets, shovels or other digging mechanisms in excavating or levelling apparatus, which tooth assembly is characterized by an adapter for removably mounting on each tooth horn of the excavating apparatus bucket, shovel or alternative excavating implement, a tooth point bolted to the tapered front end of the adapter and a pair of wear caps bolted to opposite sides of the adapter between the tooth point and the tooth horn.

Another object of this invention is to provide a tooth assembly for mounting on each of the teeth of an excavating or levelling apparatus bucket, shovel or alternative digging implement, which tooth assembly includes a wedge-shaped, transversely-slotted adapter for mounting on the tooth horn of the excavating apparatus, a wedge-shaped tooth point fitted with facing tooth point flanges for transversely engaging the corresponding transverse slots located in the adapter and removably fitting the tooth point to the adapter and top and bottom wear caps, each fitted with transverse ribs adapted for engaging corresponding additional grooves or slots provided in the adapter, for transversely mounting the wear caps on opposite sides of the adapter rearwardly of the tooth point to facilitate extended wear of the tooth assembly during excavating or levelling operations.

A still further object of this invention is to provide a tooth assembly for mounting on the conventional tooth horn of individual teeth in the bucket or shovel of various excavating apparatus, which tooth assembly includes a transversely slotted, wedge-shaped adapter having a lock opening in the top for securing the adapter to the tooth horn, a pair of L-shaped wear caps, each fitted with parallel ribs for engaging the corresponding transversely-oriented slots in the adapter and a pair of bolts for securing the wear caps to the adapter and further including a tooth point, also optionally fitted with a bolt opening and having spaced, facing tooth point flanges for engaging additional corresponding transverse grooves located in the adapter and a bolt or lock plate for securing the tooth point to the adapter forward of the wear caps.

SUMMARY OF THE INVENTION

These and other objects of the invention are provided in tooth assemblies for mounting on corresponding spaced, tooth horns of excavating and levelling apparatus, each tooth assembly including a wedge-shaped adapter which tapers from an adapter base at one end to a narrow nose ridge at the opposite end and provided with parallel top and bottom rib slots and point rib slots which extend transversely across the bottom and top, wedge-shaped faces of the adapter; a tapered tooth point fitted with spaced, inwardly-facing point flanges designed to engage the parallel and spaced point rib slots in the adapter and slidably secure the tooth point on the adapter and a bolt extending through the tooth point wall into the adapter, or a lock plate seated in the open side of the tooth point, for securing the tooth point on the adapter; a pair of L-shaped top and bottom wear caps, each provided with cap plate ribs for engaging the parallel top and bottom rib slots, respectively, in the adapter and seating the wear caps on the top and bottom of the adapter from opposite directions; and a bolt extending through each of the wear caps, respectively and threaded into the adapter for removably securing the wear caps on the adapter.

BRIEF DESCRIPTION OF THE DRAWINGS

The invention will be better understood by reference to the accompanying drawings, wherein:

FIG. 1 is a left side perspective view of a preferred embodiment of the tooth assembly of this invention, mounted on a conventional tooth horn of a bucket or shovel of an excavating apparatus;

FIG. 3 is a front, exploded view, partially in section, of the tooth assembly;

FIG. 4 is a side view taken along line 4—4, of the top wear cap element of the tooth assembly illustrated in FIG. 3;

FIG. 5 is an enlarged perspective, partially sectional view of a wear cap bolt oriented for securing a wear cap element to the adapter element of the tooth assembly;

FIG. 6 is a sectional view of a bolt shoulder extending through the side plate recess of the bottom wear cap for mounting the bottom wear cap on the adapter element of the tooth assembly;

FIG. 7 is a left side view of a preferred embodiment of the adapter element of the tooth assembly;

FIG. 8 is a top view of the adapter element illustrated in FIG. 7;

FIG. 9 is a right side view of a preferred tooth point element of the tooth assembly mounted on the extreme front portion of the adapter;

FIG. 10 is a left side view, partially in section, of the tooth point, top wear cap and bottom wear cap elements mounted on the adapter element of the tooth assembly;

FIG. 11 is a top view of the top wear cap element of the tooth assembly;

DESCRIPTION OF THE PREFERRED EMBODIMENTS

Figures 2A, 2B:
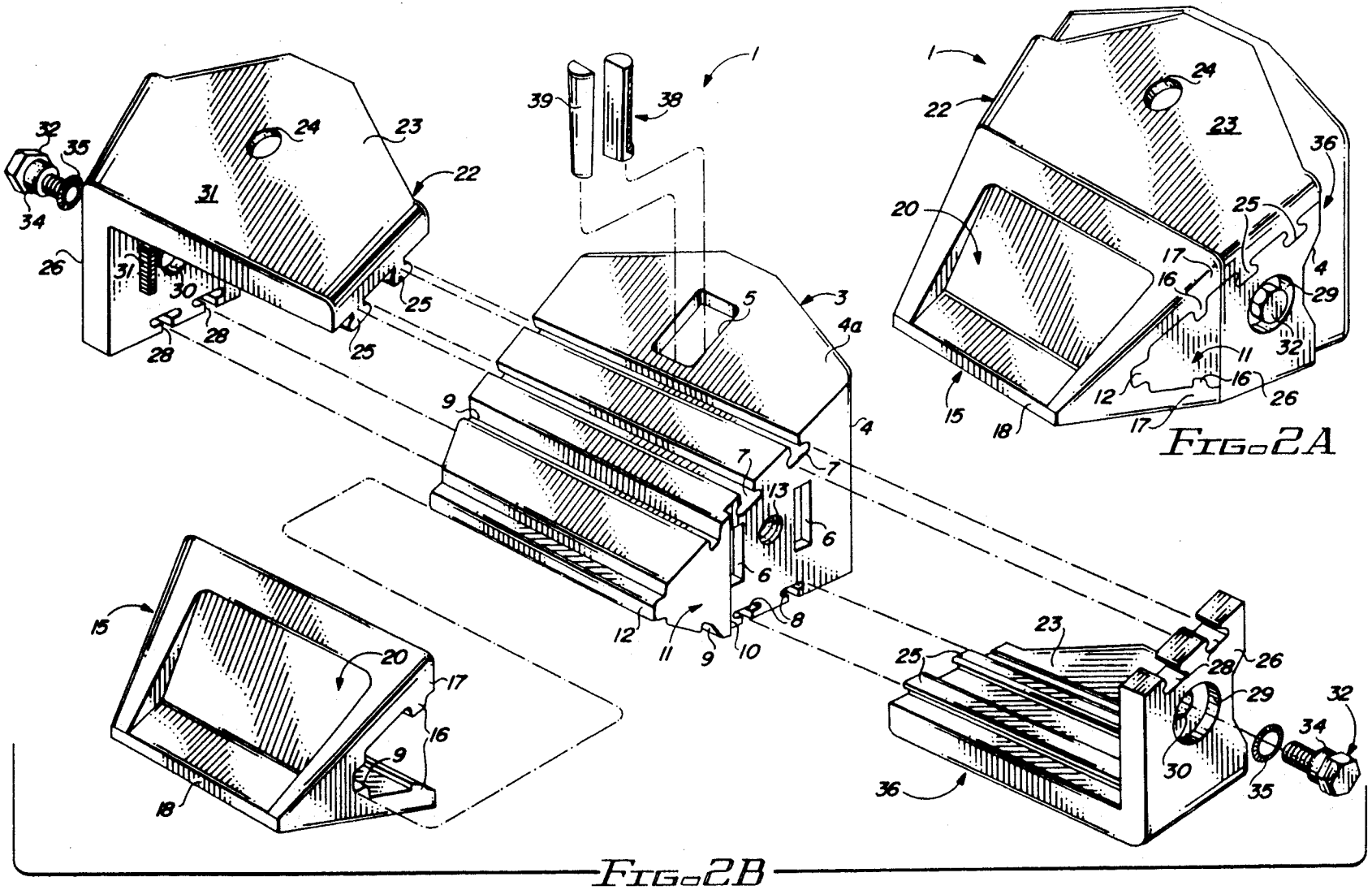
FIG. 2A is a right side perspective view of the tooth assembly illustrated in FIG. 1.
FIG. 2B is an exploded view of the tooth assembly illustrated in FIG. 2A.

Referring to the drawings and FIGS. 1 and 2 in particular, the tooth assembly of this invention is generally illustrated by reference numeral 1 and is mounted on a conventional tooth horn 2 of the bucket or shovel 2*a* of a conventional excavator (not illustrated). The tooth assembly 1 includes a wedge-shaped adapter 3, fitted with a removable tooth point 15, which is transversely mounted on the adapter 3 by means of a tooth point bolt 33 and further including a transversely-mounted top wear cap 22 and bottom wear cap 36, both of which are also bolted to the adapter 3 by means of side plate bolts 32, respectively. Referring now to FIGS. 2A and 2B of the drawings, in a most preferred embodiment of the invention the adapter 3 includes a wedge-shaped adapter base 4 which tapers from a base plate 4*a* to a nose ridge 12, terminating the adapter nose 11. A base plate lock opening 5 is provided in the base plate 4*a* of the adapter base 4 for receiving a spool 38 and a companion wedge 39 and mounting the adapter 3 on the tooth horn 2 in conventional fashion. A pair of transverse, vertically-oriented, spaced stabilizing slots 6 are provided in the sides of the adapter base 4 and a threaded bolt opening 13 is also provided in both sides of the adapter base 4, for purposes which will be hereinafter further described. Spaced, parallel top rib slots 7 are also provided transversely in the top tapered face of the base plate 4*a* of the adapter base 4 and in a most preferred embodiment, the top rib slots 7 are T-shaped, as illustrated in the drawings. Similarly, a pair of spaced, T-shaped bottom rib slots 8 are provided in the bottom tapered surface or face of the adapter base plate 4*a* in the same relative position as the top rib slots 7. A pair of transverse, T-shaped point rib slots 9 are also provided in the adapter base 4 forwardly of the top rib slots 7 and bottom rib slots 8. It will be understood that the top rib slots 7, bottom rib slots 8 and point rib slots 9 may alternatively be shaped in a "dove-tail", or alternative locking configuration, according to the knowledge of those skilled in the art.

As further illustrated in FIGS. 2A, 2B, 3, 4 and 8, the top wear cap 22 and bottom wear cap 36 are designed to slidably mount transversely on the adapter base 4 of the adapter 3. The L-shaped top wear cap 22 and bottom wear cap 36 are each characterized by identical cap plates 23 and corresponding side plates 26 and are therefore interchangeable. The top wear cap 22 further includes a cap plate opening 24, which registers with the base plate lock opening 5 located in the adapter 3, to provide access to the spool 38 and wedge 39 for readily tensioning the wedge 39 if necessary, as illustrated in FIG. 2B. A pair of spaced, T-shaped cap plate ribs 25 are transversely located in the bottom surface of the cap plate 23 of the top wear cap 22 and are designed to register with the spaced top rib slots 7 provided in the adapter 3. Similarly, additional cap plate ribs 25 are provided in spaced relationship in the top surface of the cap plate 23 of the bottom wear cap 36 for registering with corresponding spaced parallel bottom rib slots 8, located in the bottom face of the adapter 3, also as illustrated in FIG. 2B. A side plate bolt opening 30 is provided in each of the side plates 26 of the top wear cap 22 and the bottom wear cap 36 for receiving the side plate bolts 32, respectively, in order to lock the top wear cap 22 on the top and one side of the adapter 3 and the bottom wear cap 36 on the bottom and opposite side of the adapter 3, as further illustrated in FIG. 2B. As illustrated in FIG. 8 of the drawing, the adapter 3 is fitted with an adapter recess 10 on one side to facilitate recessing of the side plate 26 of the bottom wear cap 36 and extension of the corresponding cap plate ribs 25, located in the bottom surface of the cap plate 23 of the top wear cap 22, into the corresponding side plate slots 28, provided in the extending end of the side plate 26 of the bottom wear cap 36. Similarly, the projecting cap plate ribs 25, located in the cap plate 23 of the bottom wear cap 36, project in registration with the corresponding side plate slots 28, located in the extending end of the side plate 26 of the top wear cap 22 when the top wear cap 22 and bottom wear cap 36 are assembled and interlocked on the adapter 3, as illustrated in FIGS. 2–5, in a most preferred embodiment of the invention. A side plate recess 29 is provided in the side plate 26 of each of the top wear cap 22 and bottom wear cap 36 and surrounds a corresponding side plate bolt opening 30, to accommodate the head of the side plate bolts 32 in countersunk, recessed relationship. Furthermore, spaced side plate lugs 31 are provided in the side plate 26 of the top wear cap 22 and bottom wear cap 36 for registering with corresponding spaced stabilizing slots 6, located in the sides of the adapter 3, respectively. Accordingly, it will be appreciated by those skilled in the art that when the top wear cap 22 and bottom wear cap 36 are mounted on the adapter 3 from opposite sides with the respective cap plate ribs 25 engaging corresponding top rib slots 7 and bottom rib slots 8 located in the bevelled top and bottom faces of the adapter base 4A, respectively, the top wear cap 22 and bottom wear cap 36 are interlocked, as illustrated in FIGS. 1 and 2A. Furthermore, insertion of the side plate bolts 32 through the respective side plate bolt openings 30 in the side plates 26 of the top wear cap 22 and bottom wear cap 36, respectively, and threading of the side plate bolts 32 in the respective threaded openings 13 located in the sides of the adapter 3, locks the top wear cap 22 and bottom wear cap 36 securely on the adapter 3, with the side plate lugs 31 engaging the corresponding stabilizing slots 6 located in the adapter 3. The top wear cap 22 and bottom wear cap 36 are thus prevented from disengaging the adapter 3 without removing the side plate bolts 32. Furthermore, the heads of the side plate bolts 32 are securely recessed inside the respective side plate recesses 29, provided in the side plates 26, to minimize the possibility of shearing the side plates bolts 32 from the tooth assembly 1.

In another preferred embodiment of the invention each of the side plate bolts 32 is provided with a bolt shoulder 34, located beneath the head thereof and a lock washer 35, illustrated in FIG. 6, may be provided on the threaded shank of the side plate bolts 32 for securing each of the side plate bolts 32 in the adapter 3, as illustrated in FIG. 6. However, in a most preferred embodiment of the invention the heads of the respective side plate bolts 32 are spaced from the recess shoulder 29A of each side plate recess 29, as illustrated in FIGS. 5 and 6. This spacing facilitates limited movement of the top wear cap 22 and bottom wear cap 36 with respect to the adapter 3 and serves a stress-relieving function to minimize damage to the tooth assembly 1 by operation of the excavation or levelling equipment upon which the tooth assembly 1 is mounted.

Referring now to FIGS. 1, 2A, 2B, 9 and 10 of the drawings, the wedge-shaped tooth point 15 is fitted with spaced tooth point flanges 16 extending in inwardly-facing relationship from the diverging tooth point legs 17. The tooth point 15 tapers from the tooth point leg 17 to a narrow contact edge 18 and a ridge groove 19 is shaped transversely in the tooth point 15 inwardly of the spaced tooth point flanges 16, and extending from the wall 17*a*, to the open side of the tooth point 15, as illustrated in FIG. 9. A shaped panel 20 is typically provided in the top and bottom face of the tooth point 15 to optimize efficiency in the digging operation. A tooth point recess 21 is provided in the wall 17 of the tooth point 15 and surrounds a tooth point bolt opening 14, which receives a tooth point bolt 33, fitted with a bolt shoulder 34, in the same manner as the side plate bolts 32, described above. Accordingly, referring now to FIGS. 2B and 10, the tooth point 15 is designed to slidably mount on the adapter nose 11 of the adapter 3 by matching the tooth point flanges 16 with the corresponding point rib slots 9 provided in the adapter 3 and transversely sliding the tooth point 15 into position. The tooth point bolt 33 is then registered with the corresponding tooth point bolt opening 14 located in the wall 17 of the tooth point 15 and threadably inserting the threaded shank of the tooth point bolt 33 into the threaded opening 13, located in the adapter 3, to secure tooth point 15 on the adapter 3. When the tooth point 15 is so inserted on the adapter 3, the tooth point legs 17 are located in close proximity to the corresponding edges of the cap plates 23 of the top wear cap 22 and bottom wear cap 36, respectively, as illustrated in FIG. 10. However, a working gap 37 is maintained between the tooth point 15 and the top wear cap 22 and bottom wear cap 36, respectively, to facilitate movement of the tooth point 15 and top wear cap 22, as well as the bottom wear cap 36, with respect to the adapter 3, as heretofore described. In this respect, in a most preferred embodiment of the invention, like the top wear cap 22 and the bottom wear cap 36, the tooth point 15 is secured to the adapter 3 using a tooth point bolt 33 which is fitted with a bolt shoulder 34 to facilitate movement of the tooth point 15 with respect to the adapter 3 in the same manner as the top wear cap 22 and bottom wear cap 36 illustrated in FIG. 6.

Figure 13:
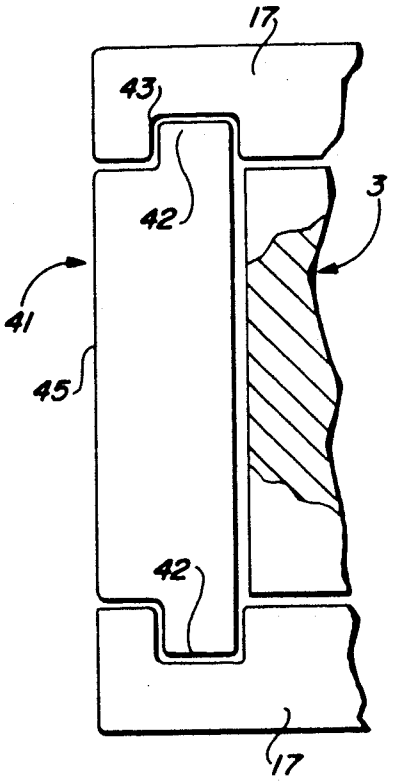
FIG. 13 is a sectional view of the tooth point taken along line 13—13 in FIG. 12.
Figure 12:
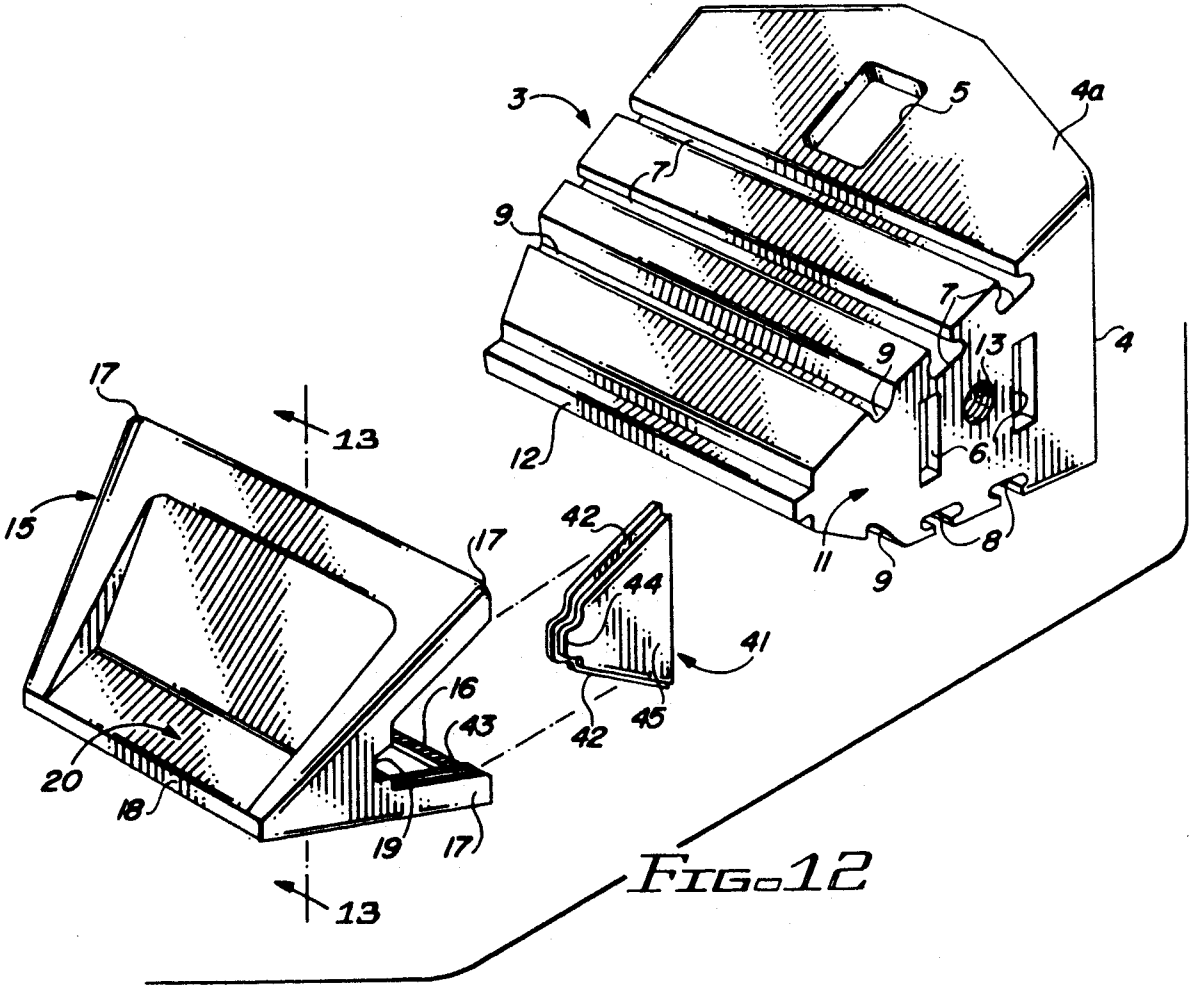
FIG. 12 is an exploded view of an alternative preferred embodiment of the tooth point element of the tooth assembly.

Referring now to FIGS. 12 and 13 of the drawings, in an alternative preferred embodiment of the invention the open side of the tooth point 15 is fitted with a flange groove 43, for slidably receiving the lock plate flange 42 of the lock plate 41, thus eliminating the necessity for a tooth point bolt 33, illustrated in FIG. 10, to secure the tooth point 15 on the adapter 3. Subsequent mounting of the top wear cap 22 and bottom wear cap 36 on the adapter 3 prevent removal of the lock plate 41 from the flange groove 43. As illustrated in FIG. 12, when the lock plate 41 is slidably seated in the flange groove 43, the plate tab 44 registers with the ridge groove 19 and there is no necessity for an adapter recess 10, illustrated in FIGS. 2B and 8, in the adapter 3.

It will be appreciated by those skilled in the art from a consideration of the drawings that the tooth assembly of this invention exhibits multiple favorable structural characteristics not found in conventional assemblies. The interlocking relationship between the top wear cap 22 and bottom wear cap 36, along with the transverse, slidable mounting of these structural members and the tooth point 15 on the adapter 3, facilitate an extremely strong, versatile wear-resistant assembly. Furthermore, recessing of the respective side plate bolts 32 and the side plates 26 of the top wear cap 22 and the bottom wear cap 36 and the tooth bolt 33 in the side of the tooth point 15, as well as the alternative lock plate 41, facilitate excavation and levelling of all types of material without fear of shearing the respective side plate bolts 32 and tooth point bolt 33. Moreover, replacement of the top wear cap 22, bottom wear cap 36 and tooth point 15 independently or in concert, is quickly and easily facilitated in an optimum way by simply removing the side plate bolts 32 and tooth point bolt 33, sliding the top wear cap 22, bottom wear cap 36 and tooth point 15 from the adapter 3 and replacing these members by reversing this procedure. Alternatively, under circumstances where a lock plate 41 is used in lieu of a tooth point bolt 33 to secure the tooth point 15 on the adapter 3, the top wear cap 22 must first be removed before removing the lock plate 41. Shock and impact resistance of the tooth assembly 1 is facilitated by mounting the top wear cap 22 and bottom wear cap 36 and tooth point 15 in a non-rigid, but secure relationship on the adapter 3 to facilitate a selected minimum movement of the top wear cap 22, bottom wear cap 36 and tooth point 15 with respect to the adapter 3. A tooth assembly 1 is mounted on each tooth horn 2 of a conventional bucket or shovel of a conventional excavating apparatus in conventional manner, utilizing the spool 38 and wedge 39 according to the knowledge of those skilled in the art. It will be appreciated that alternative means for mounting the tooth assembly 1 to the tooth horn of such equipment may also be implemented without departing from the spirit and scope of the invention as embodied herein.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A tooth assembly for mounting on a tooth horn of an excavating apparatus, comprising wedge-shaped adapter means adapted for mounting on the tooth horn; a pair of first slot means provided in said adapter means in transverse relationship with respect to the longitudinal axis of said adapter means; point means having a pair of spaced point flanges adapted for slidably and transversely engaging said first slot means and removably mounting said point means on said adapter means; point bolt means adapted for bolting said point means to said adapter means; second slot means provided in said adapter means in spaced, substantially parallel relationship with respect to said first slot means; a pair of wear cap means having wear cap ribs adapted for engaging said second slot means and removably mounting said wear cap means on said adapter means adjacent to said point means; and wear cap bolt means adapted for bolting said wear cap means to said adapter means, whereby said point means and said wear cap means may be transversely slidably removed from said adapter responsive to removal of said point bolt means and said wear cap bolt means, respectively.

2. The tooth assembly of claim 1 further comprising at least one stabilizing slot provided in each side of said adapter means and at least one lug provided in each of said wear cap means for engaging said stabilizing slot, respectively, when said wear cap means are positioned on said adapter means.

3. The tooth assembly of claim 1 further comprising a lock opening provided in said adapter means, a cap plate opening provided in a top one of said wear cap means, said cap plate opening positioned in registration with said lock opening and lock means adapted for insertion in said lock opening and engaging the tooth horn, for locking said adapter means on the tooth horn.

4. The tooth assembly of claim 1 further comprising:

(a) at least one stabilizing slot provided in each side of said adapter means and at least one lug provided on each of said wear cap means for engaging said stabilizing slot, respectively, when said wear cap means are positioned on said adapter means; and (b) a lock opening provided in said adapter means, a cap plate opening provided in a top one of said wear cap means, said cap plate opening positioned in registration with said lock opening and lock means adapted for insertion in said lock opening and engaging the tooth horn, for locking said adapter means on the tooth horn.

5. The tooth assembly of claim 1 wherein said first slot means and said second slot means further comprise inverted T-slots and said point flanges and said wear cap ribs each further comprises a T-shaped member for slidably engaging said inverted T-slots, respectively.

6. The tooth assembly of claim 5 further comprising:

(a) at least one stabilizing slot provided in each side of said adapter means and at least one lug provided on each of said wear cap means for engaging said stabilizing slot, respectively, when said wear cap means are positioned on said adapter means; and (b) a lock opening provided in said adapter means, a cap plate opening provided in a top one of said wear cap means, said cap plate opening positioned in registration with said lock opening and lock means adapted for insertion in said lock opening and engaging the tooth horn, for locking said adapter means on the tooth horn.

7. The tooth assembly of claim 1 further comprising a point bolt recess opening provided in said point means for accessing said point bolt means, a point bolt threaded aperture provided in said adapter means in alignment with said point recess opening for threadably receiving said point bolt means, a wear cap recess opening provided in each of said wear cap means for accessing said wear cap bolt means and a pair of wear cap threaded apertures provided in opposite sides of said adapter means for threadably receiving said wear cap bolt means, respectively.

8. The tooth assembly of claim 7 further comprising at least one stabilizing slot provided in each side of said adapter means and at least one lug provided on each of said wear cap means for engaging said stabilizing slot, respectively, when said wear cap means are positioned on said adapter means.

9. The tooth assembly of claim 8 further comprising a lock opening provided in said adapter means, a cap plate opening provided in the top one of said wear cap means, said cap plate opening positioned in registration with said lock opening and lock means adapted for insertion in said lock opening and engaging the tooth horn, for locking said adapter means on the tooth horn.

10. The tooth assembly of claim 9 wherein said first slot means and said second slot means further comprise inverted T-slots and said point flanges and said wear cap ribs each further comprises a T-shaped member for slidably engaging said inverted T-slots, respectively.

11. A tooth assembly for mounting on the tooth horn of a bucket or shovel in an excavating apparatus, comprising a wedge-shaped adapter having a longitudinal taper extending from a maximum height at a base end to a narrow nose end, and spaced, substantially parallel tooth point slots and wear cap slots located in top and bottom faces of said adapter, respectively, in transverse relationship with respect to said longitudinal taper; a threaded point bolt aperture provided in one side of said adapter and a pair of threaded wear cap apertures provided in opposite sides of said adapter; a wedge-shaped tooth point having a point bolt recess opening provided with a first recess shoulder and a pair of spaced, parallel transverse point flanges adapted for slidably and transversely engaging said tooth point slots and removably mounting said tooth point on said nose end of said adapter; a point bolt having a first bolt shoulder adapted for seating in said point bolt recess opening against said adapter and threadably engaging said threaded point bolt aperture and removably securing said tooth point on said nose end of said adapter; a pair of L-shaped wear caps, each having a wear cap recess opening provided with a second recess shoulder and a pair of spaced, parallel, transverse wear cap ribs adapted for slidably and transversely engaging said wear cap slots, respectively, and removably mounting said wear caps on said adapter adjacent to said tooth point; and a pair of wear cap bolts, each having a second bolt shoulder adapted for seating in said wear cap recess openings against said adapter, respectively, and threadably engaging said threaded wear cap apertures, respectively, and removably securing said wear caps on said adapter with the heads of said wear cap bolts spaced from said second recess shoulder, whereby said tooth point and said wear caps have minimal movement with respect to said adapter responsive to operation of said excavating apparatus.

12. The tooth assembly of claim 11 further comprising at least one stabilizing slot provided in each side of said adapter and at least one lug provided on each of said wear caps for engaging said stabilizing slot, respectively, when said wear caps are positioned on said adapter.

13. The tooth assembly of claim 11 further comprising a lock opening provided in said adapter, a cap plate opening provided in a top one of said wear caps, said cap plate opening positioned in registration with said lock opening and lock means adapted for insertion in said lock opening and engaging the tooth horn, for locking said adapter on the tooth horn.

14. The tooth assembly of claim 11 further comprising:

(a) at least one stabilizing slot provided in each side of said adapter and at least one lug provided on each of said wear caps for engaging said stabilizing slot, respectively, when said wear caps are positioned on said adapter; and (b) a lock opening provided in said adapter, a cap plate opening provided in a top one of said wear caps, said cap plate opening positioned in registration with said lock opening and lock means adapted for insertion in said lock opening and engaging the tooth horn, for locking said adapter on the tooth horn.

15. The tooth assembly of claim 11 wherein said tooth point slots and said wear cap slots further comprise T-shaped slots and said point flanges and said wear cap ribs further comprise T-shaped members for slidably engaging said T-shaped slots, respectively.

16. The tooth assembly of claim 15 further comprising:

(a) at least one stabilizing slot provided in each side of said adapter and at least one lug provided on each of said wear caps for engaging said stabilizing slot, respectively, when said wear caps are positioned on said adapter; and (b) a lock opening provided in said adapter, a cap plate opening provided in a top one of said wear plates, said cap plate opening positioned in registration with said lock opening and lock means adapted for insertion in said lock opening and engaging the tooth horn, for locking said adapter on the tooth horn.

17. A tooth assembly for mounting on the tooth horn of a digging implement in an excavating apparatus, comprising a wedge-shaped adapter adapted for mounting on the tooth horn; a pair of first slots provided in top and bottom faces of said adapter in transverse relationship with respect to the longitudinal axis of said adapter; a tooth point having a pair of spaced, facing point flanges adapted for engaging said first slots and removably mounting said tooth point on said adapter and a flange groove on one side of said tooth point; a lock plate having a lock plate flange for engaging said flange groove and securing said tooth point to said adapter; a pair of second slots provided in each of said top and bottom faces of said adapter in spaced, substantially parallel relationship with respect to said first slots, respectively; a pair of L-shaped wear caps having wear cap ribs adapted for engaging said second slots, respectively, from opposite directions and removably mounting said wear caps on said adapter spaced from said tooth point; and a pair of wear cap bolts adapted for bolting said wear caps to said adapter, respectively, whereby said tooth point and said wear caps may be slidably removed from said adapter responsive to removal of said wear cap bolts and said lock plate, respectively.

18. The tooth assembly of claim 17 further comprising at least one stabilizing slot provided in each side of said adapter and at least one lug provided on each of said wear caps for engaging said stabilizing slot, respectively, when said wear caps are positioned on said adapter.

19. The tooth assembly of claim 18 further comprising a lock opening provided in said adapter, a cap plate opening provided in a top one of said wear caps, said cap plate opening positioned in registration with said lock opening and lock means adapted for insertion in said lock opening and engaging the tooth horn, for locking said adapter on the tooth horn.

20. The tooth assembly of claim 19 wherein said tooth point slots and said wear cap slots further comprise T-shaped slots and said point flanges and said wear cap ribs further comprise T-shaped members for slidably engaging said T-shaped slots, respectively.

* * * * *